United States Patent [19]

Mort et al.

[11] Patent Number: 4,737,429

[45] Date of Patent: Apr. 12, 1988

[54] LAYERED AMORPHOUS SILICON IMAGING MEMBERS

[75] Inventors: Joseph Mort, Webster; Frank Jansen, Walworth; Koji Okumura, Rochester; Steven J. Grammatica, E. Rochester; Michael A. Morgan, Penfield, all of N.Y.

[73] Assignee: Xerox Corporation, Stamford, Conn.

[21] Appl. No.: 878,714

[22] Filed: Jun. 26, 1986

[51] Int. Cl.[4] ..... G03G 5/082

[52] U.S. Cl. ..... 430/58; 430/66; 430/67; 252/501.1; 357/2

[58] Field of Search ..... 430/58, 60, 66, 67, 430/128; 252/501.1; 357/2

[56] References Cited

U.S. PATENT DOCUMENTS

| | | | |
|---|---|---|---|
| 4,414,319 | 11/1983 | Shirai et al. | 430/65 |
| 4,486,521 | 12/1984 | Misumi et al. | 430/65 |
| 4,495,262 | 1/1985 | Matsuzaki et al. | 430/58 |
| 4,510,224 | 4/1985 | Yamazaki et al. | 430/57 |
| 4,518,670 | 5/1985 | Matsuzaki et al. | 430/58 |
| 4,544,617 | 11/1985 | Mort et al. | 430/58 |
| 4,582,769 | 4/1986 | Kido et al. | 430/66 X |

FOREIGN PATENT DOCUMENTS

| | | | |
|---|---|---|---|
| 3525357 | 1/1986 | Fed. Rep. of Germany | 430/58 |
| 59-67546 | 4/1984 | Japan | 430/58 |
| 59-229565 | 12/1984 | Japan | 430/66 |
| 60-61760 | 4/1985 | Japan | 430/66 |
| 60-63541 | 4/1985 | Japan | 430/60 |
| 60-178459 | 9/1985 | Japan | 430/58 |
| 60-235153 | 11/1985 | Japan | 430/58 |
| 61-25153 | 2/1986 | Japan | 430/58 |

*Primary Examiner*—Roland E. Martin
*Attorney, Agent, or Firm*—E. O. Palazzo

[57] ABSTRACT

An electrostatographic imaging member comprised of a supporting substrate; a hydrogenated amorphous silicon photogenerator layer; and in contact therewith a plasma deposited charge transporting layer with components therein selected from the group consisting of silicon nitrides, boron nitrides, aluminum nitrides, phosphorous nitrides, gallium nitrides, boron phosphides, aluminum phosphides, boron oxides, aluminum oxides, gallium oxides, and organosilanes; and wherein the transporting layer contains therein hydrogen, halides, or mixtures thereof.

49 Claims, 1 Drawing Sheet

LAYERED AMORPHOUS SILICON IMAGING MEMBERS

BACKGROUND OF THE INVENTION

This invention is generally directed to layered hydrogenated amorphous silicon imaging members; and more specifically, the present invention is directed to layered photoconductive imaging members comprised of hydrogenated amorphous silicon and certain charge transport layers. Therefore, in one embodiment of the present invention, there is provided a layered photoresponsive imaging member comprised of a supporting substrate, hydrogenated amorphous silicon, and in contact therewith a transport layer comprised of very specific components inclusive of nitrides, phosphides, and oxides, such as silicon nitride, boron phosphide, and boron oxide. Further, in an alternative specific embodiment of the present invention there is provided a layered photoresponsive imaging member wherein the specific charge transport layer is situated between the supporting substrate and the photoconductive hydrogenated amorphous silicon layer. These imaging members can be incorporated into electrophotograpic, and in particular xerographic imaging and printing systems wherein, for example, the latent electrostatic patterns which are formed can be developed into images of high quality and excellent resolution. Moreover, the members of the present invention possess high charge acceptance values corresponding to electric fields in excess of 50 volts per micron (50 v/$\mu$m); and further these members can be of a very desirable thickness from, for example, about 10 microns or less. Also, the imaging members of the present invention have desirable low dark decay properties enabling them to be very useful in xerographic imaging processes. In these processes, latent electrostatic images are formed on the devices involved, followed by development, transfer and fixing. Additionally, the photoresponsive imaging members of the present invention, when incorporated into xerographic imaging and printing systems; are insensitive to humidity and corona ions permitting the formation of acceptable images of high resolution for an extended number of imaging cycles.

Electrostatographic imaging, particularly xerographic imaging processes, are well known, and are extensively described in the prior art. In these processes a photoconductor material is selected for forming the latent electrostatic image thereon. The photoreceptor is generally comprised of a conductive substrate containing on its surface a layer of photoconductive material; and in many instances, a thin barrier layer is situated therebetween to prevent charge injection from the substrate, which injection could adversely effect the quality of the resulting image. Examples of known useful photoconductive materials include amorphous selenium, alloys for selenium such as selenium-tellurium, selenium-arsenic, and the like. Additionally, there can be selected as the photoresponsive imaging member various organic photoconductive materials including, for example, complexes of trinitrofluorenone and polyvinylcarbazole. Recently there has been disclosed layered organic photoresponsive devices with aryl amine hole transporting molecules, and photogeneratig layers, reference U.S. Pat. No. 4,265,990, the disclosure of which is totally incorporated herein by reference.

Also known are amorphous silicon photoconductors, reference for example U.S. Pat. Nos. 4,265,991 and 4,225,222. There is disclosed in the '3 991 patent an electrophotographic photosensitive member comprised of a substrate, and a photoconductive overlayer of amorphous silicon containing 10 to 40 atomic percent of hydrogen and having a thickness of 5 to 80 microns. Additionally, this patent describes several processes for preparing amorphous silicon. In one process embodiment, there is prepared an electrophotographic photosensitive member by heating the member present in a chamber to a temperature of 50° C. to 350° C., introducing a gas with silicon and hydrogen atoms, providing an electrical discharge in the chamber by electric energy to ionize the gas, followed by depositing amorphous silicon on an electrophotographic substrate at a rate of 0.5 to 100 Angstroms per second by utilizing an electric discharge thereby resulting in an amorphous silicon photoconductive layer of a predetermined thickness. Although the amorphous silicon device described in this patent is photosensitive, after a minimum number of imaging cycles, less than about 100 for example, unacceptable low quality images of poor resolution with many deletions may result. With further cycling, that is subsequent to 100 imaging cycles and after 1,000 imaging cycles, the image quality may continue to deteriorate often until images are completely deleted.

Further, there is disclosed in the prior art amorphous silicon photoreceptor imaging members containing, for example, stoichiometric silicon nitride overcoatings; however, these members in some instances generate prints of low resolution as a result of the electric field induced lateral conductivity in the photogenerator layer. Additionally, with the aforementioned silicon nitride overcoatings, the resolution loss can in many instances be extreme thereby preventing, for example, any images formation whatsoever.

Other representative prior art disclosing amorphous silicon imaging members, including those with overcoatings, are U.S. Pat. Nos. 4,460,669; 4,465,750; 4,394,426; 4,394,425; 4,409,308; 4,414,319; 4,443,529; 4,452,874; 4,452,875; 4,483,911; 4,359,512; 4,403,026; 4,416,962; 4,423,133; 4,460,670; 4,461,820; 4,484,809; and 4,490,453. Additionally, patents that may be of background interest with respect to amorphous silicon photoreceptor members include, for example, U.S. Pat.. Nos. 4,359,512; 4,377,628; 4,420,546; 4,471,042; 4,477,549; 4,486,521; and 4,490,454.

Further, additional representative prior art patents that disclose amorphous silicon imaging members include, for example U.S. Pat. No. 4,357,179 directed to methods for preparing imaging members containing high density amorphous silicon or germanium; U.S. Pat. No. 4,237,501 which discloses a method for preparing hydrogenated amorphous silicon wherein ammonia is introduced into a reaction chamber; U.S. Pat. Nos. 4,359,514; 4,404,076; 4,403,026; 4,397,933; 4,423,133; 4,461,819; 4,237,151; 4,356,246; 4,361,638; 4,365,013; 3,160,521; 3,160,522; 3,496,037; 4,394,426; and 3,892,650. Of specific interest are the amorphous silicon photoreceptors illustrated in U.S. Pat. No. 4,510,224, which discloses an electrophotographic photoreceptor comprising a hydrogenated amorphous silicon carbide transport layer 2 formed below a photoconductive layer 3, reference FIG. 5; U.S. Pat. No. 4,518,670 directed to an electrophotographic member comprising a transport layer 2 with at least one atomic percent nitrogen present therein, see FIGS. 1 to 4; and U.S. Pat. No. 4,495,262 describing an electrophotographic photosensitive member comprising two amorphous hydrogen silicon carbide layers 2 and 4, one on each side of the photoconductive layer 3, refrence FIGS. 1 and 2. Additionally, processes for depositing large area defect free films of amorphous silicon by the glow discharge of silane gases are described in Cittick et al., the Journal of the Electrochemical Society, Volume 116, Page 77, (1969). Further, the fabrication and optimization of substrate temperatures during amorphous silicon fabrication is illustrated by Walter Spear, the Fifth International Conference on Amorphous and Liquid Semiconductors presented at Garmisch Partenkirchen, West Germany in 1963. Other silicon fabrication processes are described in the Journal of Noncrystalline Solids, Volumes 8 to 10, Page 727, (1972), and the Journal of Noncrystalline Solids, Volume 13, Page 55, (1973).

There are also illustrated in copending applications photoconductive imaging members comprised of amorphous silicon. Accordingly, for example, there is illustrated in copending application U.S. Ser. No. 695,990, entitled Electrophotographic Devices Containing Compensated Amorphous Silicon Compositions, the disclosure of which is totally incorporated herein by reference, an imaging member comprised of a supporting substrate and an amorphous hydrogenated silicon composition containing from about 25 parts per million by weight to about 1 percent by weight of boron compensated with substantially equal amounts of phosphorus. Furthermore, described in copending application U.S. Ser. No. 548,117, entitled Electrophotographic Devices Containing Overcoated Amorphous Silicon Compositions, the disclosure of which is totally incorporated herein by reference, are imaging members comprised of a supporting substrate, an amorphous silicon layer, a trapping layer comprised of doped amorphous silicon, and a top overcoating layer of stoichiometric silicon nitrides. More specifically, there is disclosed in this copending application an imaging member comprised of a supporting substrate, a carrier transport layer comprised of uncompensated or undoped amorphous silicon; or amorphous silicon slightly doped with p or n type dopants such as boron or phosphorus, a thin trapping layer comprised of amorphous silicon which is heavily doped with p or n type dopants such as boron or phosphorus; and a top overcoating layer of specific stoichiometric silicon nitride, silicon carbide, or amorphous carbon. However, one disadvantage with this imaging member is that the trapping layer introduces a dark decay component which reduces the charge acceptance for the imaging member.

Additionally, described in copending application U.S. Ser. No. 662,328 entitled Heterogeneous Electrophotographic Imaging Members of Amorphous Silicon, the disclosure of which is totally incorporated herein by reference, are imaging members comprised of hydrogenated amorphous silicon photogenerating compositions, and a charge transporting layer of plasma deposited silicon oxide containing at least 50 atomic percent of oxygen. The imaging member of the present invention is comprised of similar components with the exception of the selection of the charge transporting layer compounds selected.

Although the above described amorphous silicon photoresponsive members, particularly those disclosed in the copending applications, are suitable, in most instances, for their intended purposes there continues to be a need for improved members comprised of amorphous silicon. Additionally, there is a need for amorphous silicon imaging members that possess desirable high charge acceptance values, low charge loss characteristics in the dark, improved adhesion characteristics, and excellent transport of electrical charges. Furthermore, there continues to be a need for improved amorphous silicon imaging members with specific charge transport layers. Also, there is a need for hydrogenated amorphous silicon imaging layers with transport layers of specific nitrides, phosphides and oxides. Further, there is a need for imaging members with the aforementioned charge transport layers, and where there is introduced therein electronic defect states by the stoichiometric control of constituent materials of sufficient density enabling transport to be accomplished by hopping between the resulting localized states. These states are positioned in the band gap of the charge transport component thus permitting the efficient injection of carriers from the amorphous silicon photogenerating layer by the choice of the defect state, and by, for example compositional grading of the interface between the photogeneration and transport layers. Furthermore there is a need for amorphous silicon imaging members with the property of low surface potential decay rates in the dark, and photosensitivity in the visible and the near visible wavelength range. There is also a need for hydrogenated amorphous silicon imaging members with improved mechanical characteristics such as the ability to bend over small radii, and which imaging members permit excellent adhesion of the layers to the substrate. Furthermore, there is a need for imaging members with improved charge transport characteristics thereby permitting the residual voltage after optical exposure to be of a relatively small value, that is from about 0 volts to about 10 volts, which voltage remains substantially constant upon repeated cycling of the imaging member.

SUMMARY OF THE INVENTION

It is therefore an object of the present invention to provide photoresponsive imaging members with specific charge transport layers.

In another object of the present invention there are provided photoresponsive imaging members comprised of hydrogenated amorphous silicon, and specific charge transport layers, which members possess high charge acceptance values, and low dark decay characteristics.

In yet another object of the present invention there are provided layered photoresponsive imaging members comprised of hydrogenated amorphous silicon, and in contact therwith a layer comprised of hydrogenated, or halogenated nitrides, phosphides, oxides, or organosilanes.

Further, in another object of the present invention there are provided layered photoresponsive imaging members comprised of specific charge transport layers situated between a supporting substrate and a photoconductive layer of hydrogenated amorphous silicon.

Moreover, in another object of the present invention there are provided layered photoresponsive imaging members comprised of specific charge transport layers, which members are rendered photosensitive in the near infrared by suitable alloying of the hydrogenated amorphous silicon photoconductor layer with germanium and tin, or compositions derivable from carbon and germanium.

Another object of the present invention resides in the provision of flexible layered hydrogenated amorphous silicon imaging members containing therein specific charge transport layers.

Furthermore, in another object of the present invention there are provided imaging and printing methods accomplished with the layered hydrogenated amorphous silicon imaging members illustrated herein.

In another object of the present invention there are provided photoresponsive imaging members comprised of specific charge transport layers and hydrogenated amorphous silicon photogeneration layers overcoated with protective layers such as silicon nitride, silicon carbide, amorphous carbon, or compositions similar to those selected for the transport layers.

These and other objects of the present invention are accomplished by the provision of a multilayered amorphous silicon photoresponsive imaging member. More specifically, in accordance with the present invention there are provided layered photoresponsive imaging members comprised of hydrogenated amorphous silicon, and in contact therewith a charge transport layer other than plasma deposited silicon oxides, which layer contains therein components that possess band gap states at a sufficiently high density to enable charge transport by their wave function overlap, and an optional top overcoating layer. Wave function overlap refers to a concept well known in solid state physics which associates a wave function with the position of a particle such as a charge carrier. Thus, the wave function is related to the statistical probability that a particle can be found in a certain position. Accordingly, an overlapping wave function of two defect sites implies that a charge carrier can travel between the two positions.

In one specific embodiment of the present invention there is provided a photoresponsive imaging member comprised of a supporting substrate; a photoconductive layer of hydrogenated amorphous silicon in contact therewith; and a charge transport layer comprised of components selected from the group consisting of hydrogenated, halogenated, or mixtures thereof of silicon nitrides, boron nitrides, aluminum nitrides, phosphorus nitrides, gallium nitrides; gallium phosphides; boron phosphides, aluminum phosphides, boron oxide, aluminum oxide, gallium oxide, and plasma deposited organosilanes. Furthermore, the photoresponsive imaging members of the present invention can contain a top protective overcoating layer. The charge transport layer can be situated between the photoconductive layer of hydrogenated amorphous silicon, and the supporting subtrate; or alternatively, is in contact with the photoconductive layer situated between the supporting substrate, and the charge transport layer.

The photoresponsive or photoconductive members of the present invention can be incorporated into variousimaging apparatuses wherein, for example, latent electrostatic images are formed followed by development, subsequently transferring the developed image to a suitable substrate; and optionally permanently affixing the image thereto. Moreover, the photoconductive imaging members of the present invention, in certain configurations, can be selected for use in xerographic printing processese, that is for example, when the member includes therein a component which is sensitive to the infrared region of the spectrum. Also, the photoresponsive imaging members of the present invention can be incorporated into imaging apparatuses wherein there is selected for rendering the images visible a liquid development process. Additionally, the photoresponsive imaging members of the present invention, when incorporated into xerographic imaging processes, possess high charge acceptances of, for example, about 100 volts per micron or greater; have very low dark decay characteristics, 100 volts per second; and can be fabricated with the desirable properties in a thickness of about 100 microns or less. Also, the photoconductive members of the present invention enable the gneration of images with high resolution for an extended number of imaging cycles exceeding in most instances 500,000 imaging cycles. Furthermore, the use of the imaging members of the present invention enables the generation of images with substantially no white spots in black backgrounds.

Specifically, therefore, the photoresponsive members of the present invention can be incorporated into xerographic printing and imaging apparatuses, inclusive of those with solid state lasers or electroluminescent light sources as these members can be rendered sufficiently sensitive to wavelengths of up to 7800 Angstroms when the photoconducting layer is suitably alloyed with germanium or tin; or fabricated from germanium-caron alloys. Also, the photoresponsive imaging members of the present invention when in use are substantially insensitive to humidity conditions, and corona ions generated from corona charging devices enabling these members to generate acceptable images of high resolution for an extended number of imaging cycles.

BRIEF DESCRIPTION OF THE DRAWINGS

For a better understanding of the present invention and further features thereof reference is made to the following description of the preferred embodiments wherein.

Figure 1:
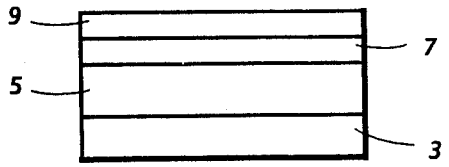
FIG. 1 is a partially schematic cross-sectional view of the photoresponsive imaging members of the present invention.

Illustrated in FIG. 1 is a photoresponsive imaging member of the present invention comprised of a supporting substrate 3, a transport layer 5 in a thickness of from about 1 to about 10 microns, and comprised of a hydrogenated, halogenated, or mixtures (50/50) of a material selected from the group consisting of plasma deposited silicon nitrides, boron nitrides, aluminum nitrides, phosphorus nitrides, gallium nitrides, gallium phosphides, boron phosphides, aluminum phosphides, boron oxides, aluminum oxides, gallium oxides, and plasma deposited organosilanes; a photogeneration layer 7 of, for example, hydrogenated amorphous silicon in a thickness of from about 0.5 to about 2 microns; and an optional transparent partially conductive top overcoating layer 9, of a thickness of from about 0.1 to about 0.5 micron.

Figure 2:
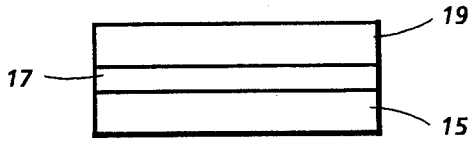
FIG. 2 is a partially schematic cross-sectional view of a further photoresponsive imaging member of the present invention.

Illustrated in FIG. 2 is a photoresponsive imaging member of the present invention comprised of a supporting substrate 15; a photogeneration layer 17 of hydrogenated, from about 10 to about 50 atomic percent of hydrogen, amorphous silicon in a thickness of from about 0.5 to about 2 microns; and a plasma deposited hydrogenerated, halogenated, or mixtures thereof charge transport layer 19 comprised of a material selected from the group consisting of silicon intrides, boron nitrides, aluminum nitrides, phosphorus nitrides, gallium nitrides, gallium phosphides, boron phosphides, aluminum phosphides, boron oxides, aluminum oxides, gallium oxides, and plasma deposited organosilanes.

Figure 3:
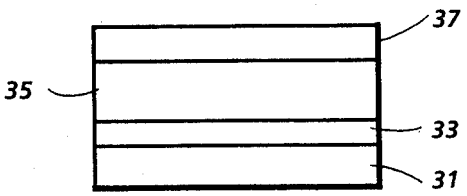
FIG. 3 is a partially schematic cross-sectional view of a further photoresponsive imaging member of the present invention.

Illustrated in FIG. 3 is a photoresponsive imaging member of the present invention comprised of a supporting substrate 31; a photogeneration layer 33 of hydrogenated amorphous silicon in a thickness of from about 0.5 to about 2 microns; and a plasma deposited hydrogenated, halogenated, or mixtures thereof charge transport layer 35 comprised of a material selected from the group consisting of plasma deposited silicon nitrides, boron nitrides, aluminum nitrides, phosphorus nitrides, gallium nitrides, gallium phosphides, boron phosphides, aluminum phosphides, boron oxides, aluminum oxides, gallium oxides, and plasma deposited organosilanes; and an optionally transparent, partially conductive top overcoating layer 37 comprised of, for example, silicon nitrides, silicon carbides, silicon oxynitrides, silicon oxides, amorphous carbon, and the like of a thickness of from about 0.1 to about 0.5 micron. The aforementioned imaging members, and others disclosed herein may be useful in either a positive or negative charging mode.

It is believed, although the scope of the present invention is not limited by theory, that a charge transport channel, or a manifold of charge transport channels in the charge transport layers can be accessed by photogenerated carriers in the hydrogenated amorphous silicon. The charge transport manifold most likely contains a high density of localized states in the forbidden gap of the charge transport component. This high density permits the charge to transfer or hop from site to site thus rendering what is commonly perceived as an insulator to be conductive for injected carriers. The ambipolar nature of the devices of the present invention indicates that the energy of the transport states in the transport layer is such that they are situated between the conduction, and the valence band of the hydrogenated amorphous silicon when brought into contact with the charge transport components.

Furthermore, the charge injection process from the amorphous silicon into the charge transport component can be facilitated by compositionally grading the interface between the silicon, and charge transport component with from zero atomic percent silicon to about 90 atomic percent of silicon over a gradient distance of up to 50 microns.

Inclusion of other elements such as germanium or tin in the hydrogenated amorphous silicon photogeneration layer of the present invention can be accomplished by the simultaneous glow discharge of, for example, silane and germane or stannane. The alloying of silicon with germanium and/or tin is useful as the band gap of the alloy is smaller than that of the hydrogenated amorphous silicon itself thus permitting photoresponse to longer wavelengths.

The supporting substrates for each of the imaging members of the present invention, particularly those illustrated in the Figures may be opaque or substantially transparent, thus this substrate can be comprised of numerous substances providing the objectives of the present invention are achieved. Specific examples or substrates are insulating materials such as inorganic or organic polymeric compositions; a layer of an organic or inorganic material having a semiconductive surface layer thereon, such as indium tin oxide; or as described in copending application U.S. Ser. No. 810,639 entitled Electrophotographic Imaging Members, the disclosure of which is totally incorporated herein by reference, an amorphous silicon layer heavily doped with boron or phosphorus thereby permitting this layer to function as a ground plane; or a conductive material such as, for example, aluminum, chromium, nickel, brass, stainless steel, and the like. The substrate may be flexible or rigid and can have many different configurations such as, for example, a plate, a cylindrical drum, a scroll, an endless flexible belt, and the like. Preferably, the substrate is in the form of a cylindrical drum, or endless flexible belt. In some situations, it may be desirable to coat on the back of the substrate, particularly when the substrate is an organic polymeric material, an anticurl layer such as, for example, polycarbonate materials commercially available as Makrolon. The substrates are prefereably comprised of aluminum, a stainless steel sleeve or an oxidized nickel composition.

Also, the thickness of the substrate layer depends on many factors including economical considerations, and the desired mechanical properties. Accordingly thus, this layer can be of a thickness of from about 0.01 inch (254 microns) to about 0.2 inch (5080 microns), and preferably is of a thickness of from about 0.05 inch (1270 microns) to about 0.15 inch (3810 microns). In one particularly preferred embodiment, the supporting substrate is comprised of oxidized nickel in a thickness of from about 25 microns to about 250 microns.

Illustrative examples of materials selected for the photogeneration layer, which can be of a thickness, for example, of from about 0.1 micron to about 10 microns, are hydrogenated amorphous silicon, preferably with 10 to 40 atomic percent of hydrogen, especially amorphous silicon as described in the copending applications referred to hereinbefore. Also, particularly useful as photogenerating compounds are hydrogenated amorphous silicon compensated with boron and phosphorus, reference copending application U.S. Ser. No. 695,990, the disclosure of which has been incorporated herein by reference. More specifically, as indicated herein there is disclosed in this copending application an amorphous silicon composition with from about 25 parts per million by weight to about 1 weight percent of boron compensated with from about 25 parts per million by weight to about 1 weight percent of phosphorus. Preferably, the photoconducting bulk layer is comprised of hydrogenated amorphous silion doped with from about 1 part per million to about 20 parts per million of boron or phosphorus.

An important layer with respect to the imaging member of the present invention is the charge transport layer containing therein the plasma deposited nitrides, phosphides, oxides or organosilanes as indicated herein. These components can be prepared by the glow discharge of the approximate mixture of gases in accordance with the parameters and process as illustrated in the copending applications referred to herein.

Illustrative examples of charge transport components include the materials detailed herein. With respect to the plasma deposited nitrides such as silicon nitride, boron nitride, aluminum nitride, phosphorus nitride, and gallium nitride, the exact composition of these transport layers depends on the composition of the precursor materials selected. The aforementioned precursor materials are selected from high vapor pressure compound of, for example, hydrides and halides inclusive of fluorides or chlorides. Further, the gas mixtures are formulated to enable the band gap of the deposited film to exceed the band gap of hydrogenated amorphous silicon which is about two electron volts. Specifically, thus silicon nitride films can be deposited by the plasma decomposition of silanes in nitrogen containing gases. Examples of such gases are nitrogen gas, ammonia and nitrogen trifluoride. The aforementioned plasma deposited nitrides generally contain therefore hydrogen or fluorine, typically from about 3 up to about 25 atomic percent. Similarly, boron nitride charge transport layers are deposited by the plasma decomposition of diborane in nitrogen containing gases, or by decomposing compounds like borazine. The boron nitride layers also generally contain hydrogen or fluorine in an amount of from about 6 to about 22 atomic percent. In a like manner, aluminum nitride charge transport layers are plasms deposited from aluminum alkyls in nitrogen containing gases, and generally contain carbon and hydrogen or fluorine as minor constituents, that is, from about 2 to about 10 atomic percent carbon, and from about 0 to about 10 atomic percent hydrogen or fluorine. Moreover, the phosphorus nitride charge transport layers deposited by the plasma decomposition of phosphine and nitrogen containing gases usually contain from about 5 to about 25 atomic percent hydrogen or fluorine. Charge transport layers comprised of gallium nitride can be formulated by the plasma decomposition of trimethyl gallium and nitrogen containing gases; and usually this layer contains from about 2 to about 20 atomic percent of carbon and hydrogen or fluorine. Furthermore, the charge transport layers comprised of the aforementioned nitrides can be formulated by the sputtering or evaporation of the appropriate Group IIIA or VA elements in a nitrogen atmosphere. Additionally, the charge transport layers can be prepared by chemical vapor deposition of the appropriate gas mixtures. More specifically, in the aforementioned sputtering and chemical vapor depositions the hydrogen or fluorine and carbon content of the charge transport layers obtained is less than that obtained with the plasma deposited layers, that is, from about 0 percent to about 20 percent of hydrogen or fluorine, and from about 0 percent to about 0.1 percent of carbon are present. In all the aforementioned processes, the wide band gap materials are obtained when the nitrogen content of the charge transport layer is at least 30 percent of the Group IIIA or VA constituent; however, these percentages can differ depending on the amount of hydrogen or fluorine and/or carbon, which is incorporated into the layer during the process of deposition.

Charge transport layers comprised of phosphides such as boron phosphide can be prepared in substantially the same manner as described herein with reference to the nitride layers with the exception, for example, that phosphine gases are utilized. Thus, for example, boron phosphide charge transport layers can be formulated by the plasma decomposition of diborane and phosphine, while aluminum phosphide transport layers are obtained from aluminum alkyls and phosphines. The latter imaging members are transparent when the aluminum content of the layer is about 40 percent of the phosphorus concentration.

With respect to charge transport layers comprised of the oxides of boron, aluminum and gallium, imaging members with these layers are particularly useful when the oxygen concentration is of a sufficient value to render the layer optically nonabsorbing. Thus, for example, in this embodiment the oxygen concentration is from about 30 to about 60 percent. These oxides can be obtained by reactive evaporation, reactive sputtering or plasma enhanced chemical vapor deposition. Optical transparency is usually obtained with these members, that is, there is a large band gap when the oxygen concentration exceeds 30 percent. The oxygenation of the boron, aluminum or gallium containing compounds can be achieved by the glow discharge reaction of these compounds together with oxygen gas or oxygen containing gases such as nitrogen-oxygen or carbon-oxygen compounds.

Charge transport layers comprised of organosilanes can be obtained by the plasma decomposition of the vapors derived from organosilane compounds. Examples of organosilanes includes tetramethylsilanes, phenylsilanes, and phenylmethylsilanes. The detailed preparation conditions of thin films from these monomers depend on the particular compound, but a few conditions are common to most materials. Flow rates of the precursor gas are generally of the order to 100 sccm and the substrate temperature is usually a few hundred degrees Celsius. The gas is decomposed at low power densities of up to 1 watts/cm$^2$ (w/cm$^2$) of electrode area; the electrical power is usually in the high or radio frequency range; and the gas pressure during decomposition is of the order of about two hundred milliTorr, for example.

Imaging members of the present invention can be prepared in accordance with the processes as described in the copending applications referred to hereinbefore. More specifically, for example, thus the imaging members of the present invention can be prepared by simultaneously introducing into a reaction chamber a silane gas often in combination with other gases for the purpose of doping or alloying, followed by the introduction of more silane gas. In one specific embodiment, the process of preparation involves providing a receptacle containing therein a first substrate electrode means, and a second counterelectrode means providing a cylindrical surface on the first electrode means, heating the cylindrical surface with heating elements contained in the first electrode means while causing the first electrode means to axially rotate, introducing into the reaction vessel a source of silicon containng gas often in combination with other diluting, doping or alloying gases at a right angle with respect to the cylindrical member, applying an rf voltage on the second electrode with the first electrode grounded whereby the silane gas is decomposed resulting in the deposition of hydrogenated amorphous silicon or doped hydrogenated amorphous silicon on the cylindrical member. Thereafter, there is introduced into the reaction chamber other appropriate gases such as ammonia or nitrogen mixtures. Other charge transport layers can be obtained by utilizing other mixtures as illustrated hereinbefore including aluminum alkyl and nitrogen or ammonia mixtures. Also, in one embodiment of the present invention the total flow rates of the gases is maintained at between 50 and 400 sccm, the gas mixture pressure is held at a constant 100 to 1,000 milliTorr, the radio freequency electrical power density is between 0.01 and 1 w/cm$^2$ of electrode area, and the substrate temperature during the deposition process can be between room temperature and 400° C.

Specifically therefore, the amorphous silicon photogeneration layer can be deposited by the glow discharge decomposition of a silane gas alone, or decomposition in the presence of small amounts of dopant gases such as diborane and/or phosphine. The range of useful flow rates, radio frequency power levels and reactor pressures are approximately the same as that described in the copending applications referred to herein.

The process and apparatus useful for preparing the photoresponsive devices of the present invention are specifically disclosed in U.S. Pat. No. 4,466,380, the disclosure of which is totally incorporated herein be reference. Specifically, the apparatus disclosed in this patent is comprised of a rotating cylindrical first electrode means 3 secured on an electrically insulating shaft; radiant heating element 2 situated within the first electrode means 3; connecting wires 6; a hollow shaft rotatably vacuum feedthrough 4; a heating source 8; a hollow drum substrate 5 containing therein the first electrode means 3, the drum substrate being secured by end flanges, which are part of the first electrode means 3; a second hollow counterelectrode means 7 with flanges thereon 9 and slits or vertical slots 10 and 11; receptacle or chamber means 15, containing as an integral part thereof receptacles 17 and 18 for flanges 9 for mounting the module in the chamber 15; a capacitive manometric vacuum sensor 23; a gauge 25; a vacuum pump 27 with a throttle valve 29; mass flow controls 31; a gauge and set point box 33; gas pressure vessels 34, 35, and 36, for example, pressure vessel 34 containing silane gas and 35 nitrous oxide; a radio frequency electrical power source means 37 for the first electrode means 3 and a second counterelectrode means 7. The chamber 15 has an entrance means 19 for the source gas material and an exhaust means 21 for the unused gas source material. In operation, the chamber 15 is evacuated by vacuum pump 27 to appropriate low pressures. Subsequently, a silane gas, often in combination with other gases originating from vessels 34, 35 and 36, are simultaneously introduced into the chamber 15 through entrance means 19, the flow of the gases being controlled by the mass flow conroller 31. These gases are introduced into the entrance 19 in a crossflow direction, that is the gas flows in the direction perpendicular to the axis of the cylindrical substrate 15 contained on the first electrode means 3. Prior to the introduction of the gases, the first electrode means is caused to rotate by a motor and power is supplied to the radiant heating elements 2 by heating source 8, while electrical power is applied to the first electrode means and a second counterelectrode means by a power soruce 37. Generally, sufficient power is applied from the heating source 8 that will maintain the drum 5 at a temperature ranging from about 150° C. to about 350° C. The pressure in the chamber 15 is automatically regulated so as to correspond to the setting specified at gauge 25 by the position of throttle valve 29. Electrical fields created between the first electrode means 3 and the second counterelectrode means 7 cause the silane gas to be decomposed by glow discharge whereby amorphous silicon based materials are deposited in a uniform thickness on the surface of the cylindrical means 5 contained on the first electrode means 3. There thus results on the substrate an amorphous silicon based film. Multilayer structures are formed by the sequential introduction and decomposition of appropriate gas mixtures as indicated herein especially the copending applications, such as U.S. Ser. No. 662,338.

Passivating and protecting overlayers such as layer 37 in FIG. 3 can be fabricated from a variety of materials. Very useful are silicon nitride layers plasma deposited from, for example, silane and ammonia mixtures. The electrical conductivity of the passivation layers should not exceed about $10^{-12}$ ohm-cm, and can be controlled by the proper choice of gas mixture deposited from silane and hydrocarbon gas, silicon oxide plasma deposited from silane and gaseous nitrogen oxygen compound, and amorphous carbon, plasma deposited from a hydrobarbon gas source.

Another specific embodiment of the present invention is directed to an electrostatographic imaging member comprised of a supporting substrate; a hydrogenated amorphous silicon photogenerator layer; and in contact therewith a plasma deposited charge transporting layer with components therein selected from the group consisting of silicon nitrides, boron nitrides, aluminum nitrides, phosphorus nitrides, gallium nitrides, gallium phosphides, boron phosphides, aluminum phosphides, boron oxides, aluminum oxides, gallium oxides, and oganosilanes; and wherein the transporting layer contains therein hydrogen, halides, inclusive of chloride and fluoride, or mixtures thereof with about 10 percent by weight to about 75 percent by weight of hydrogen.

This invention will now be described in detail with respect to specific preferred embodiments thereof, it being understood that these examples are intended to be illustrative only. The invention is not intended to be limited to the mateials, conditions or process parameters recited herein. All parts and percentages are by weight unless otherwise indicated.

The amorphous silicon photoreceptor members prepared were tested in a standard scanner, reference specifically Example II, for the purpose of determining the photoconductive characteristics thereof. The scanner is an apparatus in which there is provision for mounting and rotating the layered imaging member product along its axis. Charging corotron exposure, erase lamps, and voltage measuring probes are mounted along the circumference of the member. Testing was affected by permitting the scanner to operate at a surface speed of 20 revolutions per minute, and subsequently subjecting the imaging member to a positive polarity of 7,000 volts corona potential with a 10 centimeter long corotron. Thereafter, the dark decay and the light induced decay of the potentials were measured by a series of electrical probes mounted along the circumference of the photoreceptor. The scanner results indicate the charging capabilities of the imaging member, that is, the dark decay values; and the discharge characteristics of the photoreceptor when subjected to light illumination.

EXAMPLE I

A hydrogenated, 25 atomic percent of hydrogen, amorphous silicon imaging member was fabricated on a 9.5 inch diameter cylindrical aluminum drum of 16.75 inches length, which was mounted in a vacuum system similar to the apparatus described in U.S. Pat. Nos. 4,513,011, and 4,446,380, the disclosures of each of these patents being totally incorporated herein by reference. The apparatus and process of the other working Examples were also selected for formulating the imaging members indicated, unless otherwise stated. Thereafter, there was deposited on the substrate, maintained at room temperature, hydrogenated, 24 atomic percent of hydrogen, $SiN_x$ by introducing into the reaction chamber silane at a flow of 50 sccm together with ammonia gas in an amount of 200 sccm. There resulted a charge transport layer of hydrogenated, 24 atomic percent of hydrogen, $SiN_x$ (where x is about 1.3) of a thickness of 5 microns. Subsequently, after stopping the plasma discharge, the drum was then heated to 200° C., and thereafter there was deposited on the $SiN_x$ charge transport layer a photogenerator layer with a thickness of 0.5 micron of hydrogenated amorphous silicon containing 20 atomic percent of hydrogen by the plasma discharge of silane gas alone in an amount of 200 standard cubic centimeters per minute (sccm).

The imaging member was then removed from the vacuum system, and it was determined by analytical techniques to consist of an aluminum drum substrate, a silicon nitride layer with a thickness of 5 microns and a hydrogenated amorphous silicon photogenerator layer with 20 atomic percent of hydrogen of a thickness of 0.5 micron. The above imaging member was then incorporated into a xerographic imaging apparatus known as the Xerox Corporation 5400$^R$ model. Images of excellent resolution and no blurring were obtained for up to 1,000 imaging cycles at which time the test was discontinued.

EXAMPLE II

An amorphous hydrogenated, 12 atomic percent hydrogen, silicon imaging member was fabricated on a 9.5 inch diameter cylindrical aluminum drum of 16.75 inches length, which was mounted in a vacuum system described in Example I. Thereafter, there was deposited on the aluminum substrate, maintained at 300° C., hydrogenated, 15 atomic percent of hydrogen, $AlN_x$, wherein X is equal to 0.97 by introducing into the reaction chamber a mixture of trimethyl aluminum gas in an amount of 25 sccm together with ammonia gas in an amount of 200 sccm. There resulted a charge transport layer of hydrogenated, 15 atomic percent of hydrogen, $AlN_x$ in a thickness of 5 microns. Subsequently, after cessation of the plasma discharge, there was deposited on the $AlN_x$ charge transport layer a photogenerator layer of hydrogenated amorphous silicon in a thickness of 0.5 micron with 12 atomic percent of hydrogen by the plasma discharge of 200 sccm of silane gas.

The imaging member formulated was then removed from the vacuum system, and it was determined by secondary ion mass spectroscopic techniques to consist of the aluminum drum substrate, and an AlNx layer (x=0.97) in a thickness of 5 microns, and a hydrogenated amorphous silicon photogenerator layer with 12 atomic percent of hydrogen in a thickness of 0.5 micron. The above imaging member was then electrically characterized in a drum scanner using negative surface charge applied by a corona charging device operated at −7000 volts. A photodischarge was induced by the illumination of the layered structure with 5500A light of an intensity of 0.5 w/cm$^2$ upon which the surface potential of the photoresponsive layer decreased from −750 volts to −10 volts.

EXAMPLE III

An amorphous hydrogenated, 20 atomic percent hydrogen, silicon imaging member was fabricated on a 9.5 inch diameter cylindrical aluminum drum of 16.75 inches length, which was mounted in a vacuum system as described in Example I. Thereafter, there was deposited on the substrate, maintained at 230° C., hydrogenated, 25 atomic percent of hydrogen, $BP_x$ by introducing into the reaction chamber a mixture of diborane gas at a flow of 100 sccm together with phosphine gas at a flow 100 sccm. There resulted a charge transport layer of hydrogenated, 25 atomic percent of hydrogen, $BP_x$ (where $x=1.0\pm0.05$) in a thickness of 5 microns. The plasma discharge was then terminated and the drum was maintained at 230° C., and thereafter there was deposited on the $BP_x$:H charge transport layer a photogenerator layer of phosphorus (1 part per million), hydrogenated amorphous silicon with 20 atomic percent of hydrogen and about 1 ppm of phosphorus, and of a thickness of 0.5 micron by the plasma discharge of silane gas in an amount of 200 sccm and phosphine in an amount of 0.002 sccm.

The resulting imaging member was then removed from the vacuum system, and it was determined by microscopic inspection techniques to consist of the aluminum drum substrate, a $BP_x$ layer in a thickness of 5 microns and a hydrogenated, 20 atomic percent of hydrogen, amorphous silicon photogenerator layer of a thickness of 0.5 micron. Thereafter, this imaging member was incorporated into a xerographic imaging apparatus similar to the model 5400® machine of Xerox Corporation. Images of excellent resolution and no blurring were obtained for up to 1,000 imaging cycles at which time the test was discontinued.

EXAMPLE IV

An amorphous hydrogenated, 20 atomic percent of hydrogen, imaging member was fabricated on a 9.5 inch diameter cylindrical aluminum drum of 16.75 inches length, which was mounted in a vacuum system described in Example I. Thereafter, there was deposited on the substrate, held at 300° C., hydrogenated $AlO_x$ by introducing into the reaction chamber a mixture of trimethyl aluminum at a flow of 50 sccm and nitrous oxide in an amount of 300 sccm. There resulted a charge transport layer of hydrogenated, 10 atomic percent of hydrogen, $AlO_x$ in a thickness of 5 microns. The plasma discharge was then terminated and the drum was then heated to 200° C., and thereafter there was deposited on the $AlO_x$ charge transport layer a photogenerator layer in a thickness of 0.5 micron boron doped hydrogenated amorphous silicon with 20 atomic percent of hydrogen and about 10 ppm of boron, by the plasma discharge of silane gas in an amount of 200 sccm and diborane in an amount of 0.001.

The imaging member was then removed from the vacuum system, and it was determined by microscopic inspection techniques to consist of an aluminum drum substrate, a $AlO_x$ layer ($x=1.45\pm0.09$) in a thickness of 5 microns, and a hydrogenated amorphous silicon photogenerator layer of a thickness of 0.5 micron. The above imaging member was then incorporated into a 5400 ®xerographic imaging apparatus. Images of excellent resolution and no blurring were obtained for up to 1,000 imaging cycles at which time the test was discontinued.

EXAMPLE V

An amorphous hydrogenated silicon, about 20 atomic percent of hydrogen, imaging member was fabricated on a 9.5 inch diameter cylindrical aluminum drum of 16.75 inches length, which was mounted in a vacuum system described in Example I. Thereafer, there was deposited on the substrate, held at room temperature, a 5 micron thick charge transport layer produced by the plasma decomposition of phenylmethyl silane introduced into the reaction chamber at a rate of 300 sccm.

There resulted a charge transport layer of a plasma decomposed film of the organosilane. The plasma discharge was then terminated and the drum was then heated to 200° C., and thereafter there was deposited on the silane charge transport layer a photogenerator layer of hydrogenated amorphous silicon with 18 atomic percent of hydrogen in a thickness of 0.5 micron by the plasma discharge of silane gas in an amount of 200 sccm.

The imaging member was then removed from the vacuum system, and it was determined by microscopic inspection techniques to consist of the aluminum drum substrate, a plasma decomposed organosilane film in a thickness of 5 microns, and a hydrogenated amorphous silicon photogenerator layer of a thickness of 0.5 micron. The above imaging member was then incorporated into a 5400® xerographic imaging apparatus. Images of excellent resolution and no blurring were obtained for up to 1,000 imaging cycles at which time the test was discontinued.

EXAMPLE VI

An imaging member was fabricated as described in Example II with the exception that ater the 0.5 micron hydrogenated amorphous silicon photogenerator layer was deposited, a 3000 Angstroms layer of $SiN_x$ was deposited as an overcoat. This $SiN_x$ overcoating was produced by the plasma discharge of a mixture of silane in an amount of 50 sccm and ammonia in an amount of 150 sccm.

The resulting imaging member was then removed from the vacuum system, and it was determined by analytical techniques to consist of the aluminum drum substrate, a $AlN_x$ transport layer in a thickness of 5 microns, a hydrogenated amorphous silicon photogenerator layer with 12 atomic percent of hydrogen of a thickness of 0.5 micron and a 3,000 Angstroms thickness top overcoating of $SiN_x$ (where $x=1.20\pm0.05$). The above imaging member was then incorporated into the 5400® xerographic imaging apparatus. Images of excellent resolution and no blurring were obtained for up to 1,000 imaging cycles at which time the test was discontinued.

EXAMPLE VII

An amorphous imaging member was fabricated on a 9.5 inch diameter cylindrical drum of 16.75 inches length, which was mounted in a vacuum system described in Example I. Thereafter, there was deposited on the substrate, heated to 200° C., a photogenerator layer of hydrogenated amorphous silicon with 20 atomic percent of hydrogen, in a thickness of 0.5 micron by the plasma discharge of silane gas in an amount of 200 sccm. The plasma discharge was then terminated and the drum was cooled to room temperature. Thereafter, a charge transport layer of hydrogenated, about 25 atomic percent of hydrogen, $BN_x$ of a thickness of 5 microns was deposited by the plasma discharge of a mixture of diborane in an amount of 50 sccm and nitrogen in an amount of 150 sccm.

The imaging member was then removed from the vacuum system, and it was determined by analytical techniques to consist of an aluminum drum substrate, a blocking layer 0.3 micron thick of hydrogenated amorphous silicon with 20 atomic percent of hydrogen, and a charge transport layer of hydrogenated, about 25 atomic percent of hydrogen, $BN_x$ ($x=1.1\pm0.2$) of a thickness of 5 microns. The above imaging member was then incorporated into a 5400® xerographic imaging apparatus similar in design and operation to the Xerox Corporation's model 5400®. Images of excellent resolution and no blurring were obtained for up to 1,000 imaging cycles at which time the test was discontinued.

EXAMPLE VIII

An amorphous hydrogenated silicon imaging member, with 20 atomic percent of hydrogen, was fabricated on a 9.5 inch diameter cylindrical drum of 16.75 inches length, which was mounted in a vacuum system described in Example I. Thereafter, there was deposited on the substrate, heated to 200° C., a photogenerator layer of an amorphous hydrogenated silicon germanium alloy produced by the plasma discharge of a mixture of silane in an amount of 150 sccm and germane in an amount of 30 sccm. There resulted a photogenerator layer of hydrogenated amorphous silicon-germanium alloy of a thickness of 0.4 micron. Thereafter, the drum substrate was heated to 250° C. and a charge transport layer of hydrogenated, with about 25 atomic percent of hydrogen $PN_x$, wherein x is 1.6, was deposited by the plasma discharge of a mixture of phosphine in an amount of 100 sccm and nitrogen in an amount of 200 sccm. Thereafter, an overcoating of $SiN_x$ was deposited by the plasma discharge of a mixture of silane in an amount of 50 sccm and ammonia in an amount of 150 sccm.

The imaging member resulting was then removed from the vacuum system, and it was determined by analytical techniques to consist of the aluminum drum substrate, a silicon-germanium photogenerator layer composition $SiGe_x$ ($x=0.3$) in a thickness of 0.4 micron, a charge transport layer of $PN_x$ ($x=1.0$) in a thickness of 5 microns, and a $SiN_x$ top overcoating layer ($x=1.2$) of a thickness of 0.3 micron. The above imaging member was then incorporated into a xerographic imaging apparatus similar in design and operation to the Xerox Corporation's model 5400®. Images of excellent resolution and no blurring were obtained for up to 1,000 imaging cycles at which time the test was discontinued.

EXAMPLE IX

An amorphous hydrogenated, 25 atomic percent of hydrogen, silicon imaging member was fabricated on a polymer (polyimide,) substrate clamped to an aluminum drum substrate held at room temperature. The polymer substrate was 50 microns in thickness. There was deposited on the substrate a heavily phosphorus doped hydrogenated, 20 atomic percent of hydrogen, amorphous silicon ground plane produced by the plasma discharge of a mixture of silane in an amount of 200 sccm and phosphine in an amount of 1 sccm. Thereafter, a charge transport layer of 5 microns in thickness was produced by the plasma discharge of phenyl silane introduced into the reaction chamber in an amount of 300 sccm, and deposited on the ground plane layer. Subsequently, the imaging member was heated to 200° C. and a photogenerator layer of 0.5 micron thickness of amorphous hydrogenated silicon was deposited by the plasma discharge of silane in an amount of 200 sccm.

The imaging member was then removed from the vacuum system, and it was determined by microscopic inspection techniques to consist of a polymer substrate in a thickness of 2 mils, a hydrogenated amorphous silicon ground plane layer in a thickness of 1 micron, doped with 10,000 ppm of phosphorus, a plasma decomposed organosilicon charge transport layer in a thickness of 5 microns, and a hydrogenated amorphous silicon photogenerator layer in a thickness of 0.5 micron. The above imaging member was then incorporated into the 5400® xerographic imaging apparatus. Images of excellent resolution and no blurring were obtained.

Although the invention has been described with reference to specific preferred embodiments, it is not intended to be limited thereto. Rather those of skill in the art will recognize that variations and modifications may be made therein which are included within the spirit of the present invention and within the scope of the following claims.

What is claimed is:

1. An electrophotographic imaging member comprised of a supporting substrate; a hydrogenated amorphous silicon photogenerator layer; and in contact therewith a plasma deposited charge transporting layer with components therein selected from the group consisting of plasma deposited boron nitrides, aluminum nitrides, phosphorus nitrides, gallium nitrides, gallium phosphides, boron phosphides, aluminum phosphides, boron oxides, aluminum oxides, gallium oxides, and organosilanes; and wherein the transporting layer contains therein hydrogen, halogens, or mixtures thereof.

2. An imaging member in accordance with claim 1 further including thereover a protective top overcoating layer.

3. An imaging member in accordance with claim 2 wherein the protective top overcoating layer is selected from the group consisting of silicon nitrides, silicon carbides and amorphous carbon.

4. An imaging member in accordance with claim 1 wherein the charge transport layer is a plasma deposited boron nitride with from about 30 to about 70 atomic percent of boron, excluding the amount of hydrogen, halogens, or mixtures thereof.

5. An imaging member in accordance with claim 1 wherein the charge transport layer is a plasma deposited aluminum nitride with from about 30 to about 70 atomic percent of aluminum, excluding the amount of hydrogen, halogens or mixtures thereof.

6. An imaging member in accordance with claim 1 wherein the charge transport layer is a plasma deposited phosphorus nitride with from about 40 to about 60 atomic percent of phosphorus, excluding the amount of hydrogen, halogens, or mixtures thereof.

7. An imaging member in accordance with claim 1 wherein the charge transport layer is a plasma deposited gallium nitride with from about 40 to about 60 atomic percent of gallium, excluding the amount of hydrogen, halogens, or mixtures thereof.

8. An imaging member in accordance with claim 1 wherein the charge transport layer is a plasma deposited gallium phosphide with from about 40 to about 60 atomic percent of gallium, excluding the amount of hydrogen, halogens or mixtures thereof.

9. An imaging member in accordance with claim 1 wherein the charge transport layer is a plasma deposited boron phosphide with from about 40 to about 60 atomic percent of boron, excluding the amount of hydrogen, halogens, or mixture thereof.

10. An imaging member in accordance with claim 1 wherein the charge transport layer is a plasma deposited aluminum phosphide with from about 40 to about 60 atomic percent of aluminum, excluding the amount of hydrogen, halogens, or mixtures thereof.

11. An imaging member in accordance with claim 1 wherein the charge transport layer is a plasma deposited boron oxide with from about 30 to about 50 atomic percent of boron, excluding the amount of hydrogen, halogens, or mixtures thereof.

12. An imaging member in accordance with claim 1 wherein the charge transport layer is a plasma deposited aluminum oxide with from about 30 to about 50 percent of aluminum, excluding the amount of hyrogen, halogens, or mixtures thereof.

13. An imaging member in accordance with claim 1 wherein the charge transport layer is a plasma deposited gallium oxide with from about 30 to about 50 atomic percent of gallium, excluding the amount of hydrogen, halogens, or mixtures thereof.

14. An imaging member in accordance with claim 1 wherein the charge transport layer is a plasma deposited organosilane.

15. An imaging member in accordance with claim 1 wherein the hydrogen amorphous silicon photogenerator layer is situated between the supporting substrate and the charge transport layer.

16. An imaging member in accordance with claim 1 wherein the photogenerator layer is comprised of a hydrogenated amorphous silicon-germanium alloy.

17. An imaging member in accordance with claim 1 wherein the photogenerator layer is comprised of a hydrogenated amorphous silicon-tin alloy.

18. An imaging member in accordance with claim 1 wherein the photogenerator layer is comprised of a hydrogenated carbon-germanium alloy.

19. An imaging member in accordance with claim 1 wherein the supporting substrate is rigid or flexible.

20. An imaging member in accordance with claim 1 wherein the supporting substrate is selected from the group consisting of aluminum, chromium, nickel, brass, and stainless steel.

21. An imaging member in accordance with claim 1 wherein the supporting substrate is comprised of an insulating material.

22. An imaging member in accordance with claim 12 wherein the insulating material is an organic polymer.

23. An imaging member in accordance with claim 1 wherein the charge transport layer is of a thickness of from about 1.0 to about 10 microns.

24. An imaging member in accordance with claim 2 wherein the overcoating results from plasma deposited silicon nitride, silicon oxynitride, silicon oxide, silicon carbide, amorphous carbon, or aluminum oxide.

25. An imaging member in accordance with claim 1 wherein there is present an interface transition gradient between the charge transport layer and the amorphous silicon photogenerator layer.

26. A method of imaging which comprises providing the photoresponsive imaging member of claim 1, subjecting this member to uniform charging, imagewise exposure, developing the resulting image with a toner composition, subsequently transferring the image to a suitable substrate, and permanently affixing the image thereto.

27. A method of imaging in accordance with claim 26 wherein the charge transport layer is a plasma deposited boron nitride with from 30 to about 70 atomic percent of boron, excluding the amount of halogens, hydrogen, or mixtures thereof.

28. A method of imaging in accordance with claim 26 wherein the charge transport layer is a plasma deposited aluminum nitride with from about 30 to 70 atomic percent of aluminum, excluding the amount of halogens, hydrogen, or mixtures thereof.

29. A method of imaging in accordance with claim 26 wherein the charge transport layer is a plasma deposited phosphorus nitride with from about 40 to about 60 atomic percent of phosphorus, and from about 0 to about 30 atomic percent of nitrogen.

30. A method of imaging in accordance with claim 26 wherein the charge transport layer is a plasma deposited gallium nitride with from about 40 to 60 atomic percent of gallium, excluding the amount of halogens, hydrogen, or mixtures thereof.

31. A method of imaging in accordance with claim 26 wherein the charge transport layer is a plasma deposited boron phosphide with from about 40 to 60 atomic percent of boron, excluding the amount of halogens, hydrogen, or mixtures thereof.

32. A method of imaging in accordance with claim 26 wherein the charge transport layer is a plasma deposited aluminum phosphide with from about 40 to 60 atomic percent of aluminum, excluding the amount of halogens, hydrogen, or mixtures thereof.

33. A method of imaging in accordance with claim 26 wherein the charge transport layer is a plasma deposited boron oxide with from about 30 to 50 atomic percent of boron, excluding the amount of halogens, hydrogen, or mixtures thereof.

34. A method of imaging in accordance with claim 26 wherein the charge transport layer is a plasma deposited aluminum oxide with from about 30 to 50 atomic percent of aluminum, excluding the amount of halogens, hydrogen, or mixtures thereof.

35. A method of imaging in accordance with claim 26 wherein the charge transport layer is a plasma deposited gallium oxide with from about 30 to 50 atomic percent of gallium, excluding the amount of halogens, hydrogen, or mixtures thereof.

36. A method of imaging in accordance with claim 26 wherein the charge transport layer is a plasma deposited organosilanes.

37. A method of imaging in accordance with claim 26 wherein the hydrogenated amorphous silicon photogenerator layer is situated between the supporting substrate and the charge transport layer.

38. A method of imaging in accordance with claim 26 wherein the photogenerator layer is comprised of a hydrogenated amorphous silicon-germanium alloy.

39. A method of imaging in accordance with claim 26 wherein the photogenerator layer is comprised of a hydrogenated amorphous silicon-tin alloy.

40. An imaging member in accordance with claim 1, wherein the phtogenerating layer contains from about 10 to about 50 atomic percent of hydrogen.

41. An imaging member in accordance with claim 2, wherein the photogenerating layer contains about 10 to about 50 atomic percent of hydrogen.

42. An imaging member in accordance with claim 1, wherein the transporting layer contains from about 2 to about 25 atomic percent of hydrogen.

43. An imaging member in accordance with claim 2 wherein the transporting layer contains from about 2 to about 25 atomic percent of hydrogen.

44. An imaging member in accordance with claim 14 wherein the charge transport layer is of a thickness of about 5 microns, hydrogen is present in an amount of about 20 atomic percent, and the organosilane is phenylmethyl silane.

45. An imaging member in accordance with claim 5 wherein the charge transport layer is of a thickness of about 5 microns, hydrogen is present in an amount of about 12 atomic percent, and the atomic percentage of aluminum is about 51.

46. An imaging member in accordance with claim 9 wherein the charge transport layer is of a thickness of about 5 microns, hydrogen is present in an amount of about 25 atomic percent, and the atomic percentage of boron is about 50.

47. An imaging member in accordance with claim 12 wherein the charge transport layer is of a thickness of about 5 microns, hydrogen is present in an amount of about 20 atomic percent, and the atomic percentage of aluminum is about 41.

48. An imaging member in accordance with claim 45 wherein the imaging member also comprises an overcoating layer of silicon nitride having a thickness of about 3,000 Angstroms.

49. An imaging member in accordance with claim 4 wherein the charge transport layer is of a thickness of about 5 microns, hydrogen is present in an atomic percent of about 20, and the atomic percentage of boron is about 48.

* * * * *